US011788218B2

(12) United States Patent
Kuo et al.

(10) Patent No.: US 11,788,218 B2
(45) Date of Patent: Oct. 17, 2023

(54) METHOD FOR MANUFACTURING INTEGRAL SHOE BLANK

(71) Applicant: Wholeknit International Co., Ltd., Apia (WS)

(72) Inventors: Ming-Sheng Kuo, Apia (WS); Yu-Lin Li, Apia (WS); Chien-Hui Yang, Apia (WS)

(73) Assignee: WHOLEKNIT INTERNATIONAL CO., LTD., Apia (WS)

( * ) Notice: Subject to any disclaimer, the term of this patent is extended or adjusted under 35 U.S.C. 154(b) by 0 days.

(21) Appl. No.: 17/987,215

(22) Filed: Nov. 15, 2022

(65) Prior Publication Data

US 2023/0076496 A1 Mar. 9, 2023

Related U.S. Application Data

(60) Division of application No. 17/099,210, filed on Nov. 16, 2020, now Pat. No. 11,555,261, which is a continuation of application No. 15/497,965, filed on Apr. 26, 2017, now Pat. No. 10,883,207.

(30) Foreign Application Priority Data

Mar. 10, 2017 (TW) ..... 106108081

(51) Int. Cl.

| | |
|---|---|
| ***D04B 1/26*** | (2006.01) |
| ***A43B 1/04*** | (2022.01) |
| ***D04B 1/24*** | (2006.01) |
| ***A43B 23/04*** | (2006.01) |
| ***A43B 23/02*** | (2006.01) |

(52) U.S. Cl.

CPC ..... *D04B 1/26* (2013.01); *A43B 1/04* (2013.01); *A43B 23/0205* (2013.01); *A43B 23/042* (2013.01); *D04B 1/24* (2013.01)

(58) Field of Classification Search

CPC ..... A43B 1/04; A43B 23/042; D04B 1/26; D04B 1/265

See application file for complete search history.

(56) References Cited

U.S. PATENT DOCUMENTS 7,748,240 B1 * 7/2010 Cherneski ..... A41B 11/008 66/185
8,572,866 B2 11/2013 Dojan et al.
8,745,895 B2 * 6/2014 Sokolowski ..... A43C 1/04 36/89

(Continued)

FOREIGN PATENT DOCUMENTS

CN 106617494 A * 5/2017 ..... A43B 23/0205
EP 2805638 A1 11/2014

(Continued)

*Primary Examiner* — Megan E Lynch

(74) *Attorney, Agent, or Firm* — Muncy, Geissler, Olds & Lowe

(57) ABSTRACT

A method for manufacturing an integral shoe blank is provided. In the method, a reinforcement piece is woven by a flat knitting machine during a weave process, and the reinforcement piece is made unperceivable through a subsequent side overturning step when viewing from an exterior of a shoe. Thus, with the reinforcement piece, structural strength of the shoe blank is reinforced while better comfort is provided to the foot by a shoe manufactured from the shoe blank.

5 Claims, 9 Drawing Sheets

(56) References Cited

U.S. PATENT DOCUMENTS

| | | | | |
|---|---|---|---|---|
| 8,997,529 | B1 * | 4/2015 | Podhajny | A43C 1/00 36/47 |
| 10,273,605 | B2 | 4/2019 | Kuo et al. | |
| 2003/0089136 | A1 * | 5/2003 | Lynch | D04B 9/40 66/187 |
| 2012/0266362 | A1 * | 10/2012 | Craig | A41B 11/005 66/185 |
| 2014/0137434 | A1 * | 5/2014 | Craig | A43B 23/0215 66/170 |
| 2015/0107307 | A1 * | 4/2015 | Kosui | D04B 1/26 2/239 |
| 2015/0223561 | A1 | 8/2015 | Kilgore et al. | |
| 2015/0250256 | A1 | 9/2015 | Pojhajny | |
| 2016/0058099 | A1 | 3/2016 | Panian et al. | |
| 2016/0089578 | A1 | 3/2016 | Liu et al. | |
| 2016/0198798 | A1 * | 7/2016 | Ikenaka | D04B 1/22 66/170 |
| 2016/0206045 | A1 * | 7/2016 | Meir | A43B 23/042 |
| 2016/0208421 | A1 | 7/2016 | Baines et al. | |
| 2016/0219966 | A1 | 8/2016 | Pojhajny et al. | |
| 2017/0000216 | A1 | 1/2017 | Dua et al. | |
| 2017/0027284 | A1 * | 2/2017 | Craig | A43B 23/021 |
| 2017/0188661 | A1 * | 7/2017 | Lee | A43C 13/00 |
| 2017/0340064 | A1 * | 11/2017 | Boucher | B29D 35/126 |
| 2017/0342612 | A1 * | 11/2017 | Kawakami | A43B 23/0245 |
| 2018/0042340 | A1 * | 2/2018 | Kuo | D04B 1/106 |
| 2018/0140050 | A1 * | 5/2018 | Kuo | A43B 23/042 |
| 2018/0168271 | A1 * | 6/2018 | Ly | A43B 23/042 |
| 2018/0289099 | A1 * | 10/2018 | Bell | A43C 11/1493 |
| 2018/0289100 | A1 * | 10/2018 | Bell | A43B 3/126 |

FOREIGN PATENT DOCUMENTS

| | | | | |
|---|---|---|---|---|
| FR | 777533 A | * | 2/1935 | |
| GB | 1253684 A | * | 11/1971 | D04B 1/108 |
| GB | 2516028 B | * | 5/2017 | A43B 1/04 |

* cited by examiner

METHOD FOR MANUFACTURING INTEGRAL SHOE BLANK

CROSS REFERENCE TO RELATED APPLICATIONS

This application is a Divisional of co-pending application Ser. No. 17/099,210, filed on Nov. 16, 2020, which is a Continuation of application Ser. No. 15/497,965, filed on Apr. 26, 2017, for which priority is claimed under 35 U.S.C. § 120; and this application claims priority of application No. 106108081 filed in Taiwan on Mar. 10, 2017 under 35 U.S.C. § 119, the entire contents of all of which are hereby incorporated by reference.

FIELD OF THE INVENTION

The present invention relates to a method for manufacturing an integral shoe blank, and particularly to a method for manufacturing an integral shoe blank including a reinforcement piece that reinforces structural strength of a shoe.

BACKGROUND OF THE INVENTION

In a conventional shoe manufacturing method, a shoe is usually spliced from multiple shoe pieces, as disclosed by the U.S. Pat. No. 8,572,866. However, with the evolving changes and trends of the footwear manufacturing industry, knitted/woven shoes have become available, such as Nike™ Free Run Flyknit. Patents associated with knitted footwear may be referred from the U.S. Patent Publication Nos. 2015/0223561, 2015/0250256, 2016/0058099, 2016/0089578, 2016/0219966, 2016/0208421 and 2017/0000216.

Further, the European Patent No. 2805638A1 discloses a footwear and knitting method for knitting a fabric. Although the footwear is seamlessly woven by a flat knitting machine, the footwear completed using the European Patent No. 2805638A1 is identical to the foregoing patents; that is, once the footwear is shaped, the shoe upper is formed merely by a piece of thin fabric. Such fabric provides limited structural strength and may not withstand frequent uses, in a way that the knitted shoe may not have a short lifespan.

Further, the European Patent No. 2805638A1 discloses that, one of the yarns (e.g., the second knitting yarn specified in the European Patent No. 2805638A1) used for knitting the knitted shoe is clad with a material having a lower melting point, such that the woven footwear may have a fixed shape through a thermal process. However, the structural strength formed by only at least two yarns adhered to each other still falls short in meeting requirements of numerous application scenarios.

SUMMARY OF THE INVENTION

It is an object of the present invention to solve unsatisfactory structural strength of a conventional knitted shoe.

To achieve the above object, the present invention provides a method for manufacturing an integral shoe blank. The method includes following steps.

In an outside-upper extension knitting step, an extension is woven by knitting at least one of at least two yarns.

In an interlacing step, an initial shoe edge connected to the extension is woven by knitting the at least two yarns in an interlaced manner.

In a shoe upper knitting step, a first shoe upper connected to the initial shoe edge is woven by knitting the at least two yarns, knitting in a reverse direction is performed when a shoe upper stitch count is reached to weave a second shoe upper that faces the first shoe upper by knitting the at least two yarns, and the first shoe upper is woven in a reverse direction according to the shoe upper stitch count, hence cyclically knitting the first shoe upper and the second shoe upper.

In a reinforcement piece knitting step, a reinforcement piece is woven by knitting at least one of the yarns when the shoe upper stitch count is reached in the shoe upper knitting step, knitting in a reverse direction is performed when an extension stitch count is reached while knitting the reinforcement piece, and the first shoe upper and the second shoe upper are woven by knitting the at least two yarns according to the shoe upper stitch count when the extension stitch count is again reached, hence cyclically knitting the reinforcement piece, the first shoe upper and the second shoe upper.

In a continual shoe upper knitting step, the first shoe upper and the second shoe upper are cyclically woven by knitting the at least two yarns.

In a lining knitting step, a first lining connected to the first shoe upper is woven by knitting the at least two yarns, knitting in a reverse direction is performed when the shoe upper stitch count is reached to weave a second lining that faces the first lining and is connected to the second shoe upper by knitting the at least two yarns, and the first lining is woven in a reverse direction according to the shoe upper stitch count, hence cyclically knitting the first lining and the second lining, with ends of the first lining and second lining forming a shoe opening.

An outside-upper another extension knitting step, in which, another extension connected to the end of the first lining or the end of the second lining is knitted by knitting at least one of the yarns.

In a side overturning step, the first lining and the second lining are folded from the shoe opening, and the first shoe upper and the second shoe upper are simultaneously drawn from the shoe opening for side overturning to locate the reinforcement piece and the extension in an in-shoe space defined by the overturned first shoe upper and second shoe upper. The extension may be a toe support piece disposed at a lower end of the in-shoe space or a sole piece adhered to the second shoe upper.

In a lining tucking step, the overturned first lining and second lining as well as the another extension are tucked towards the in-shoe space, the ends of the first lining and second lining are secured at the lower end of the in-shoe space, and the extension and the another extension are respectively the toe support piece disposed at the lower end of the in-shoe space and the sole piece adhered to the second lining, to complete a shoe blank.

In one embodiment, before tucking the first lining and the second lining into the in-shoe space in the lining tucking step, edges of the first lining and the second lining are sewn.

In one embodiment, one of the two yarns is clad with a hot melt layer.

In one embodiment, the extension stitch count is greater than the shoe upper stitch count.

In one embodiment, the knitting length of the extension is shorter than the knitting lengths of the first shoe upper and the second shoe upper.

The embodiments of the present invention provide following features compared to the prior art. In the present invention, a reinforcement piece is integrally woven during the knitting process of a flat knitting machine, and the reinforcement piece is hidden in the in-shoe space or clamped between the first shoe upper and the first lining in the subsequent side overturning step. Thus, the manufactured shoe blank is provided with reinforced structural strength through the reinforcement piece as well as better comfort for the foot using a shoe body manufactured from the shoe blank. Further, during the knitting process of the present invention, at least one extension may be integrally woven. The at least one extension further reinforces the structural strength or decorates an appearance of the shoe blank.

DETAILED DESCRIPTION OF THE PREFERRED EMBODIMENTS

Figure 1:
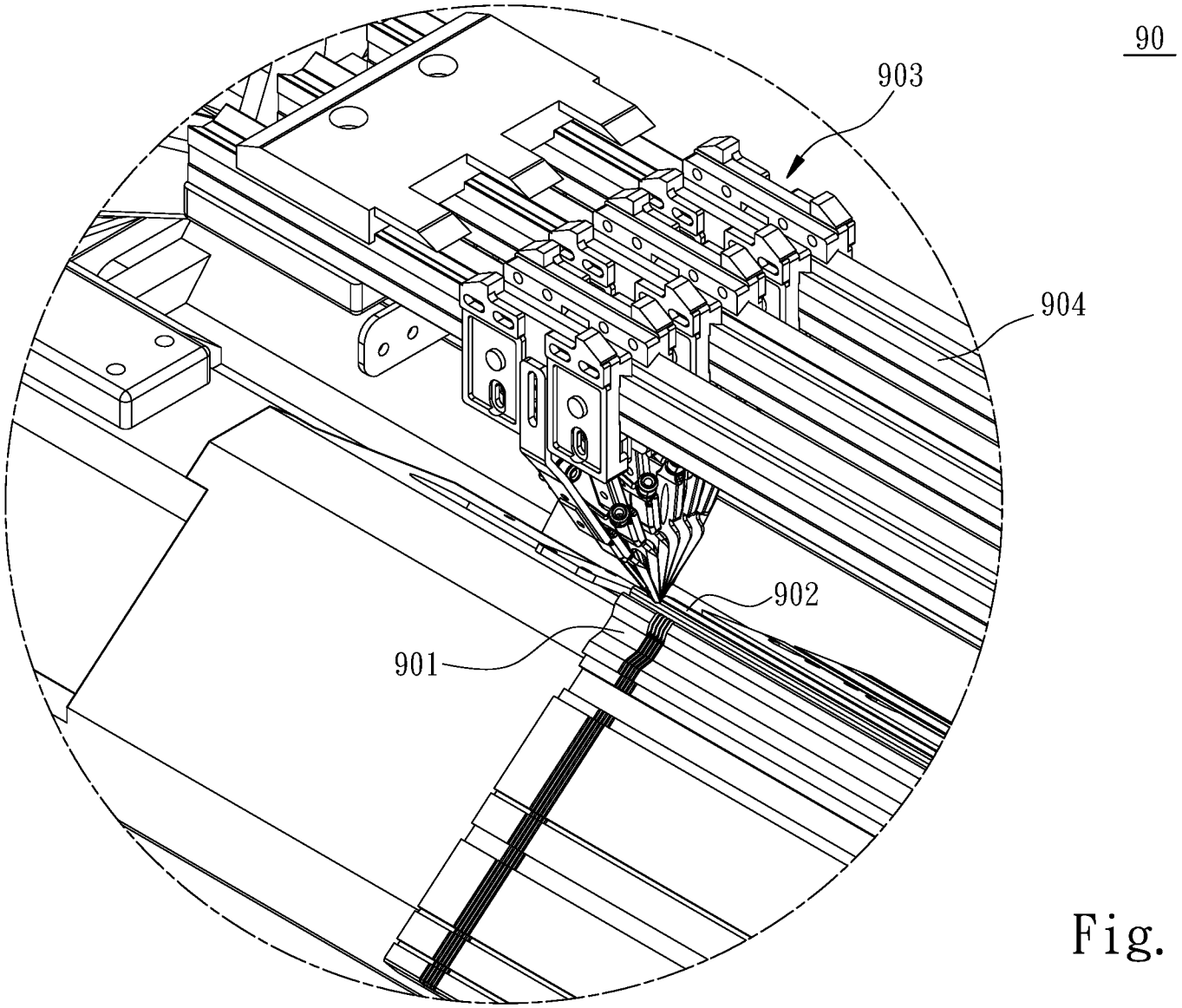
FIG. 1 is a partial schematic diagram of a flat knitting machine.

Referring to FIG. 1, the present invention provides a method for manufacturing an integral shoe blank. Steps associated with knitting in the method disclosed by the present invention are completed by a flat knitting machine 90, and performed by a front needle bed 901 and a back needle bed 902 of the flat knitting machine 90. Structural details of the front needle bed 901 and the back needle bed 902 are generally known to one person skilled in the art, and shall be omitted herein. An operating staff of the flat knitting machine 90 may configure the knitting scheduling of the front needle bed 901 and the back needle bed 902 according to the method of the present invention. Further, a yarn feeding mechanism 903 of the flat knitting machine 90 moves along a lateral track 904. More specifically, the yarn feeding machanism 903 moves from an initial position towards an ending position on the lateral track 904, and moves back from the ending position towards the initial position, hence cyclically causing the front needle bed 901 and the back needle bed 902 to weave a fabric. Further, the yarn feeding mechanism 903 is implemented in coordination with a nose (not shown), which controls the knitting operations of the front needle bed 901 and the back needle bed 902.

Figure 2:
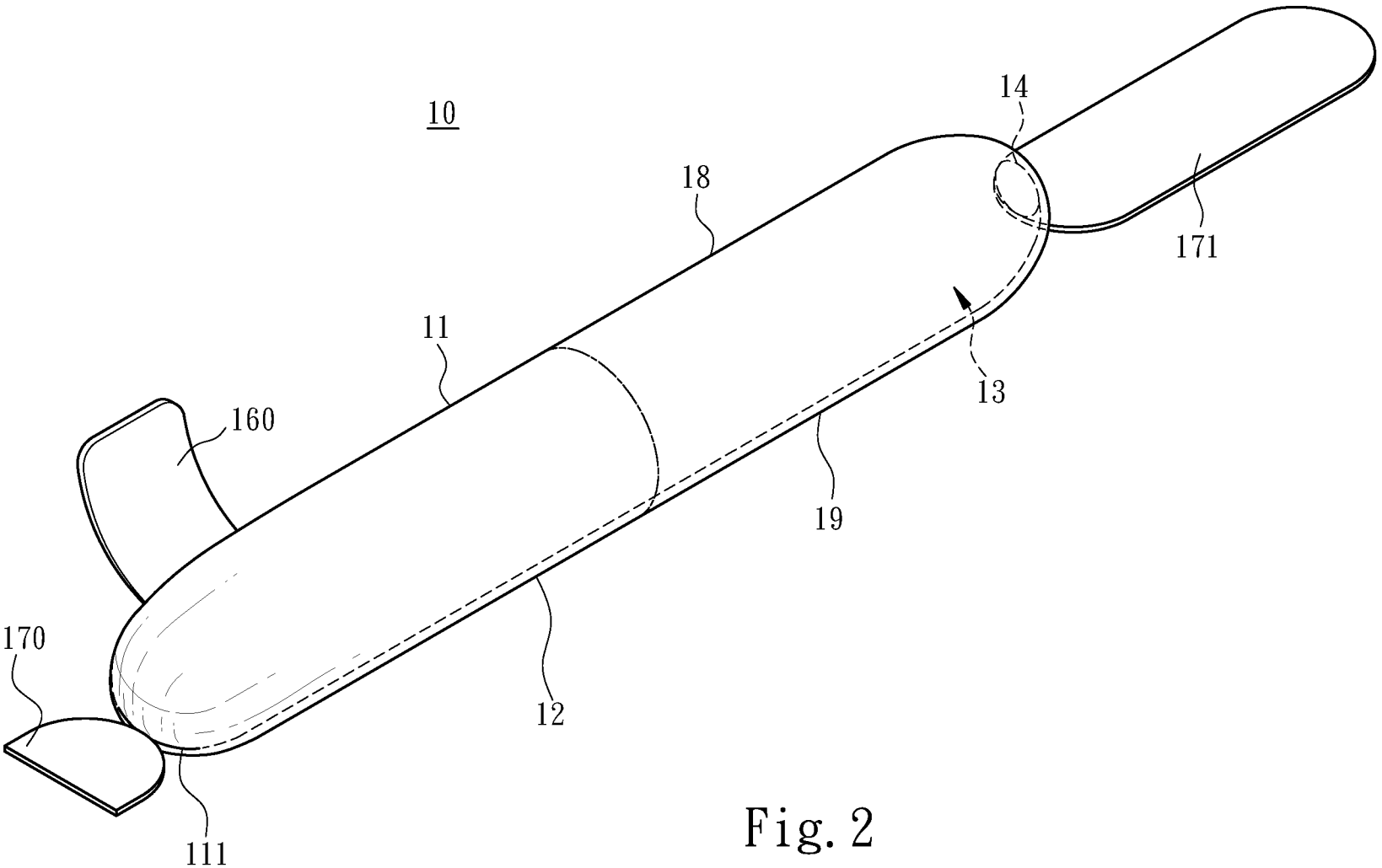
FIG. 2 is a perspective structural schematic diagram of a shoe blank according to a first embodiment of the present invention.
Figure 3:
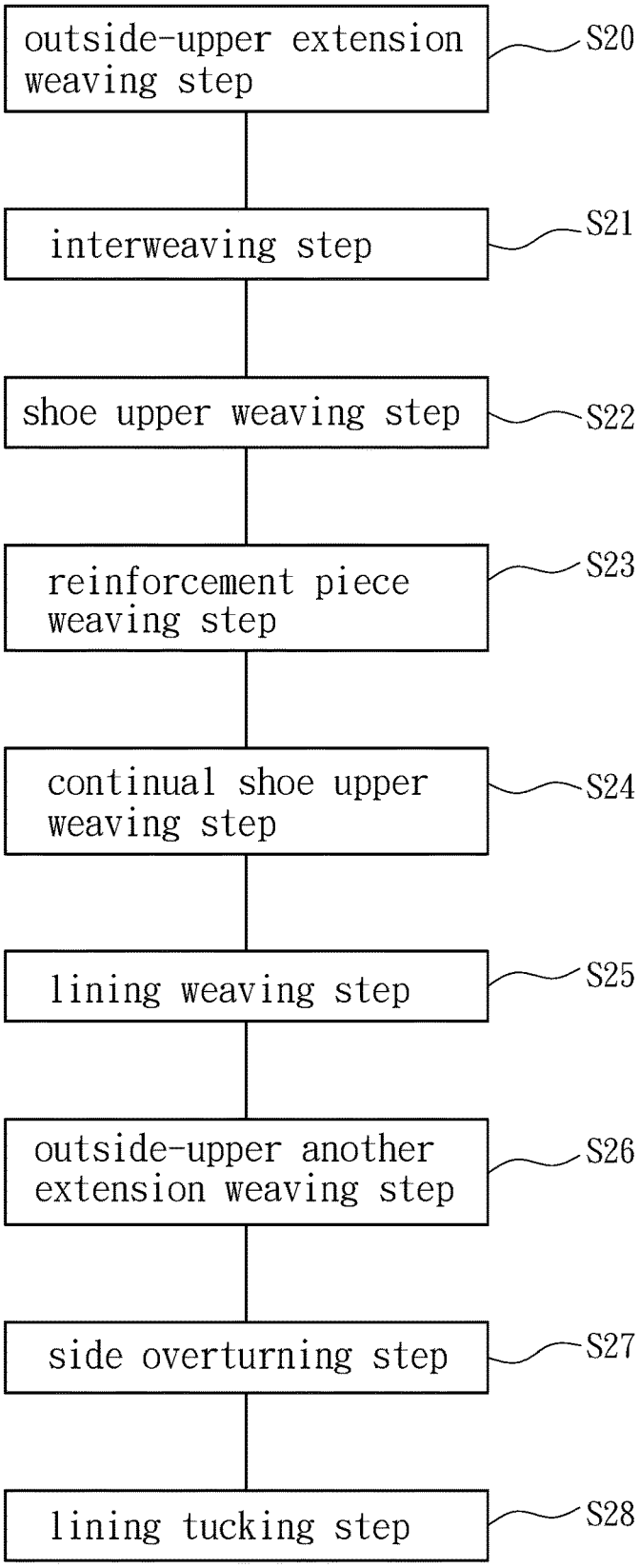
FIG. 3 is a flowchart of steps of a method according to the first embodiment of the present invention.
Figure 4A:
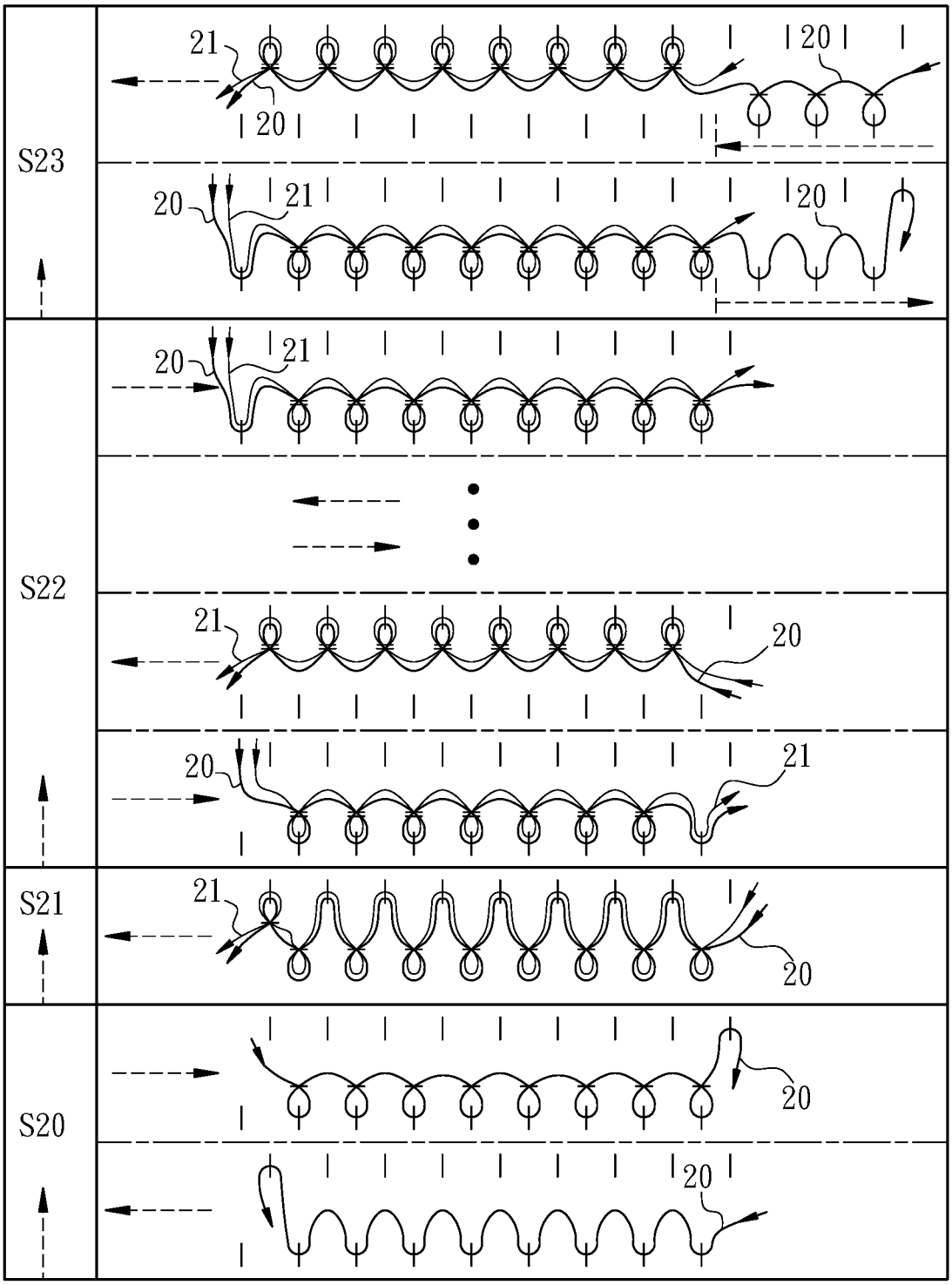
FIG. 4A and FIG. 4B are first and second schematic diagrams of a knitting process according to the first embodiment of the present invention.
Figure 4B:
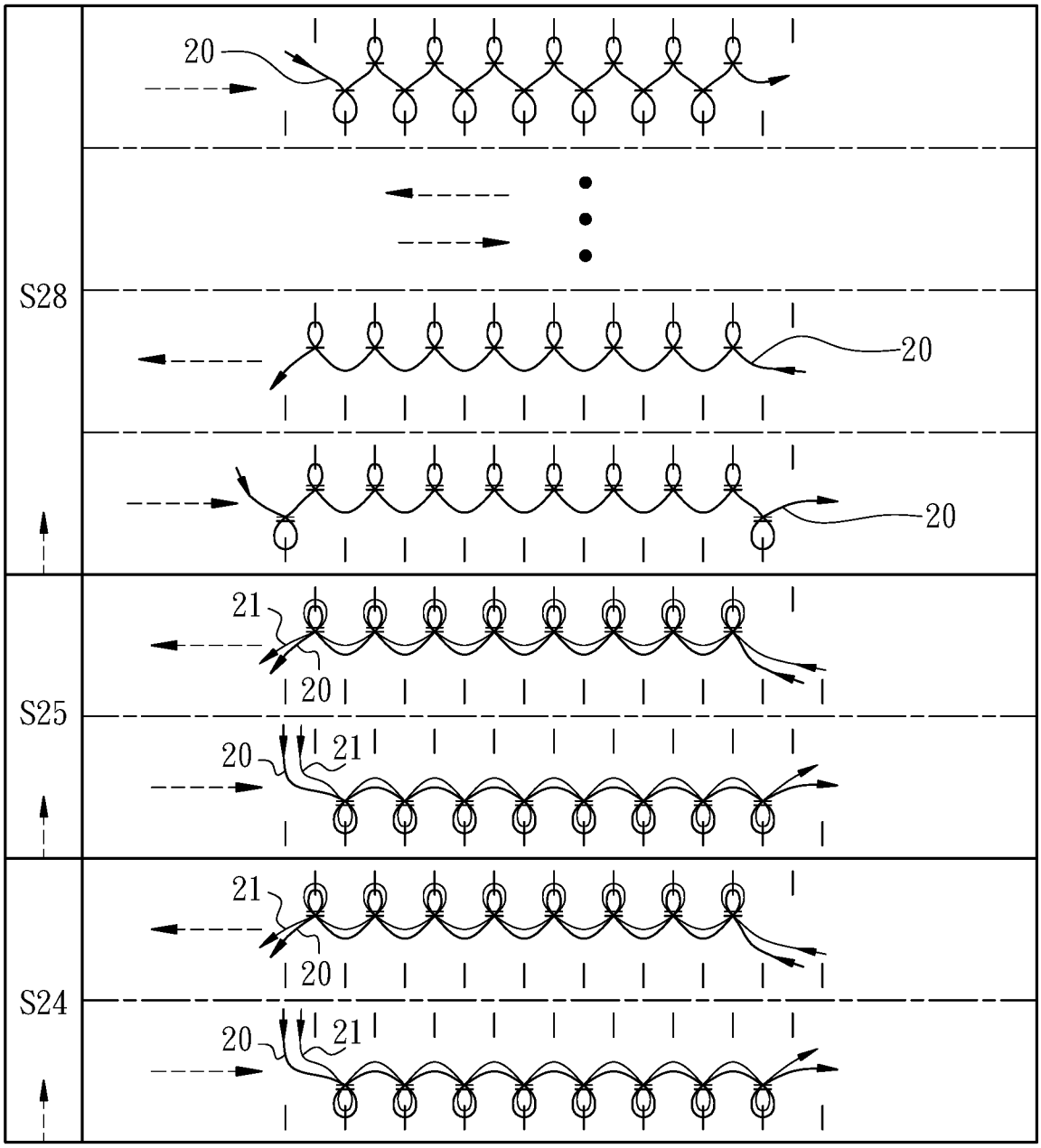

Referring to FIG. 2, a basic structure of the shoe blank 10 is first given below. The shoe blank 10 is a semi-finished product integrally formed and woven by the flat knitting machine 90, and completed through a side overturning step. The shoe blank 10 includes a first shoe upper 11, a second shoe upper 12 that faces the first shoe upper 12, an in-shoe space 13 defined by the first shoe upper 11 and the second shoe upper 13, and a shoe opening 14 connected to the in-shoe space 13.

Referring to FIG. 2 to FIG. 6, in one embodiment, the method includes following steps.

An outside-upper extension knitting step S20, an extension 170 is woven by knitting at least one of yarns 20 and 21.

In an interlacing step S21, an initial shoe edge 111 connected to the extension 170 is woven by knitting the at least two yarns 20 and 21 in an interlaced manner.

In a shoe upper knitting step S22, the first shoe upper 11 connected to the initial shoe edge 111 is woven by knitting the at least two yarns 20 and 21, knitting in a reverse direction is performed when the shoe upper stitch count is reached to weave the second shoe upper 12 that faces the first shoe upper 11 by knitting the two yarns 20 and 21, and the first shoe upper 11 is woven in a reverse direction according to the shoe upper stitch count, hence cyclically knitting the first shoe upper 11 and the second shoe upper 12.

In a reinforcement piece knitting step S23, a reinforcement piece 160 is woven by knitting at least one of the yarns 20 and 21 when the shoe upper stitch count is reached in the shoe upper knitting step S22, knitting in a reverse direction is performed when the extension stitch count is reached while knitting the reinforcement piece 160, and the first shoe upper 11 and the second shoe upper 12 are woven by knitting the at least two yarns 20 and 21 according to the shoe upper stitch count when the extension stitch count is again reached, hence cyclically knitting the reinforcement piece 160, the first shoe upper 11 and the second shoe upper 12.

In a continual shoe upper knitting step S24, the first shoe upper 11 and the second shoe upper 12 are cyclically woven by knitting the two yarns 20 and 21.

In a lining knitting step S25, a first lining 18 connected to the first shoe upper 11 is woven by knitting the at least two yarns 20 and 21, knitting in a reverse direction is performed when the shoe upper stitch count is reached to weave a second lining 19 that faces the first lining 18 and is connected to the second shoe upper 12 by knitting the two yarns 20 and 21, and the first lining 18 is woven in a reverse direction according to the shoe upper stitch count, hence cyclically knitting the first lining 18 and the second lining 19. Ends of the first lining 18 and the second lining 19 form the shoe opening 14.

An another outside-upper another extension knitting step S28, in which another extension 171 connected to the end of the first lining 18 or the end of the second lining 19 is woven by knitting at least one of the yarns 20 and 21.

In a side overturning step S27, the first lining 18 and the second lining 19 are folded from the shoe opening 14, and the first shoe upper 11 and the second shoe upper 12 are simultaneously drawn to be overturned, so as to locate the reinforcement piece 160 and the extension 170 in the in-shoe space 13 defined by the overturned first shoe upper 11 and second shoe upper 12. The extension 170 may be the toe support piece disposed at the lower end of the in-shoe space 13 or the sole piece adhered to the second shoe upper 12.

In a lining tucking step S28, the overturned first lining 18 and second lining 19 as well as the another extension are tucked towards the in-shoe space 13, and ends of the first lining 18 and the second lining 19 are secured to the lower end of the in-shoe space 13, and the extension 170 and the another extension 171 are respectively the toe support piece disposed at the lower end of the in-shoe space 13 and the sole piece adhered to the second lining 19, to complete the shoe blank 10.

More specifically, at the beginning of the implementation of the embodiment, the front needle bed 901 and the back needle bed 902 of the flat knitting machine 90 are set to first knit at least one of the yarns 20 and 21 at the beginning of knitting the shoe blank 10 to form the extension 170. After the extension 170 is completely woven, the flat knitting machine 90 causes the front needle bed 901 and the back needle bed 902 to knit simultaneously to cause the two yarns 20 and 21 to be interlaced to form the initial shoe edge 111. After the initial shoe edge 111 is completely woven, unbroken-yarn knitting is continued to perform the shoe upper knitting step S22. During the knitting process of the shoe upper knitting step S22, the front needle bed 901 weaves the first shoe upper 11 in an extended manner from an end of one side of the initial shoe edge 111. When the front needle bed 901 reaches the shoe upper stitch count while knitting the first shoe upper 11, the flat knitting machine 90 continues unbroken-yarn knitting and performs yarn feeding in a reverse direction to cause the back needle bed 902 to continue knitting the second shoe upper 12 by knitting the two yarns 20 and 21. After that, each time the front needle bed 901 or the back needle bed 902 reaches the shoe upper stitch count during the knitting process, the flat knitting machine 90 performs knitting in a reverse direction, hence cyclically knitting the first shoe upper 11 and the second shoe upper 12. The reinforcement piece knitting step S23 is then performed. At the beginning of the reinforcement piece knitting step S23, the flat knitting machine 90 is at the knitting ending point of the first shoe upper 11 or the second shoe upper 12, the yarn feeding mechanism 903 is controlled to progress in a non-reversed direction, and the flat knitting machine 90 continues knitting the reinforcement piece 160 along the current knitting direction by knitting the at least one of the yarns 20 and 21. During the process of knitting the reinforcement piece 160, the flat knitting machine 90 controls the nose to progress in a non-reversed direction for knitting and the front needle bed 901 to weave the reinforcement piece 160, such that the woven reinforcement piece 160 protrudes from edges of the first shoe upper 11 and the second shoe upper. Further, the during the process of knitting the reinforcement piece 160, the flat knitting machine 90 continues knitting the reinforcement piece 160 in a reverse direction when the front needle bed 901 reaches the extension stitch count while knitting the reinforcement piece 160, and causes the front needle bed 901 and the back needle bed 902 to continue knitting the first shoe upper 11 and the second shoe upper 12 by knitting the two yarns 20 and 21 when the extension stitch count is again reached. Details of the knitting process of the first shoe upper 11 and the second shoe upper 12 are as described in the shoe upper knitting step S22, and shall be omitted herein. Further, the extension stitch count is greater than the shoe upper stitch count.

The continual shoe upper knitting step S24 is performed after the reinforcement piece knitting step S23 is completed. The continual shoe upper knitting step S24 is similar to the knitting method in the shoe upper knitting step S22. In the continual shoe upper knitting step S24, from the knitting ending point of the reinforcement piece knitting step S23, the front needle bed 901 and the back needle bed 902 continue knitting the first shoe upper 11 and the second shoe upper 12. The lining knitting step S25 follows after the reinforcement piece knitting step S24 is completed. In the lining knitting step S25, a knitting starting point is the end of the first shoe upper 11 or the second shoe upper 12, e.g., an intersection of the first shoe upper 11 and the second shoe upper 12. The flat knitting machine 90 causes the front needle bed 901 and the back needle bed 902 to weave the second lining 19 connected to the second shoe upper 12 by knitting the two yarns 20 and 21. When the back needle bed 902 reaches the shoe upper stitch count while knitting the second lining 19, the flat knitting machine 90 performs unbroken-yarn knitting and causes the yarn feeding mechanism 903 to perform yarn feeding in a reverse direction to weave the first lining 18 connected to the first shoe upper 11 by the front needle bed 901, hence cyclically knitting the first lining 18 and the second lining 19 in an unbroken-yarn manner to complete the knitting process. Further, although the knitting process of the second lining 19 is given as an example in this embodiment, the knitting sequences of the first lining 18 and the second lining 19 may be modified according to knitting scheduling settings in practice. Further, the knitting method of the first lining 18 and the second lining 19 may be identical to that of the first shoe upper 11 and the second shoe upper 12. Further, the knitting lengths of the first lining 18 and the second lining 19 may be similar to those of the first shoe upper 11 and the second shoe upper 12.

More specifically, after the knitting process of the lining knitting step S25 is completed, the outside-upper another extension knitting step S26 is performed, the flat knitting machine 90 performs unbroken-yarn knitting and weaves the another extension 171 at an edge of the first lining 18 or the second lining 19. The another extension 171 may be formed by single-sided knitting or dual-sided knitting, with associated details referred from the description on the knitting method of the reinforcement piece 160 of the present invention and omitted herein.

Figure 5A:
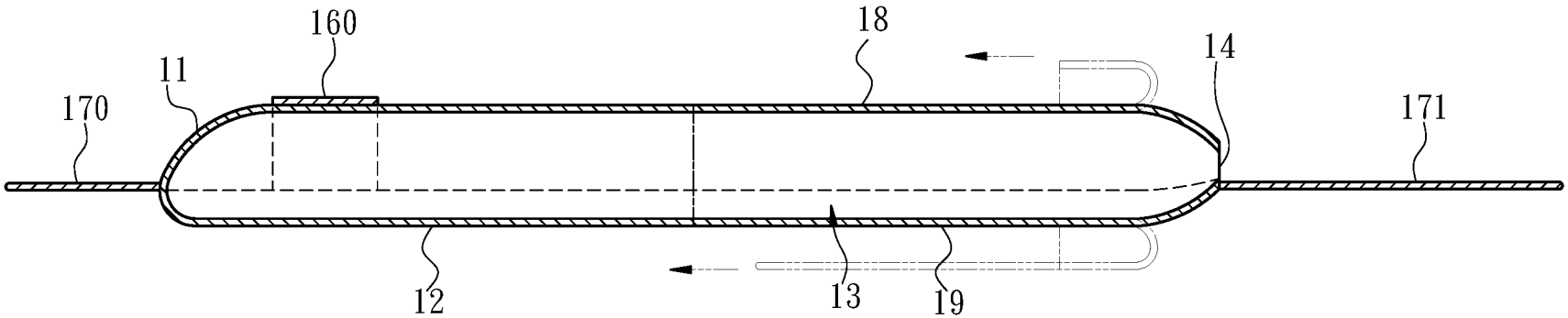
FIG. 5A to FIG. 5E are first to fifth continuous schematic diagrams of a folding and overturning process according to the first embodiment of the present invention.
Figure 5B:
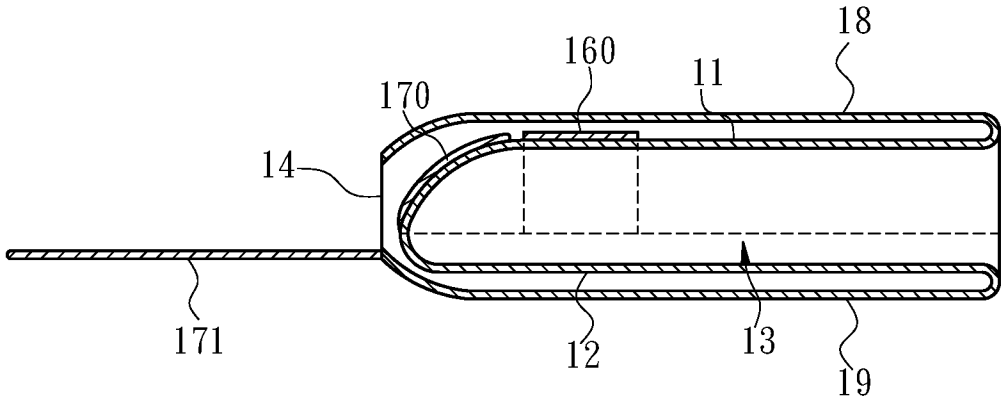
Figure 5C:
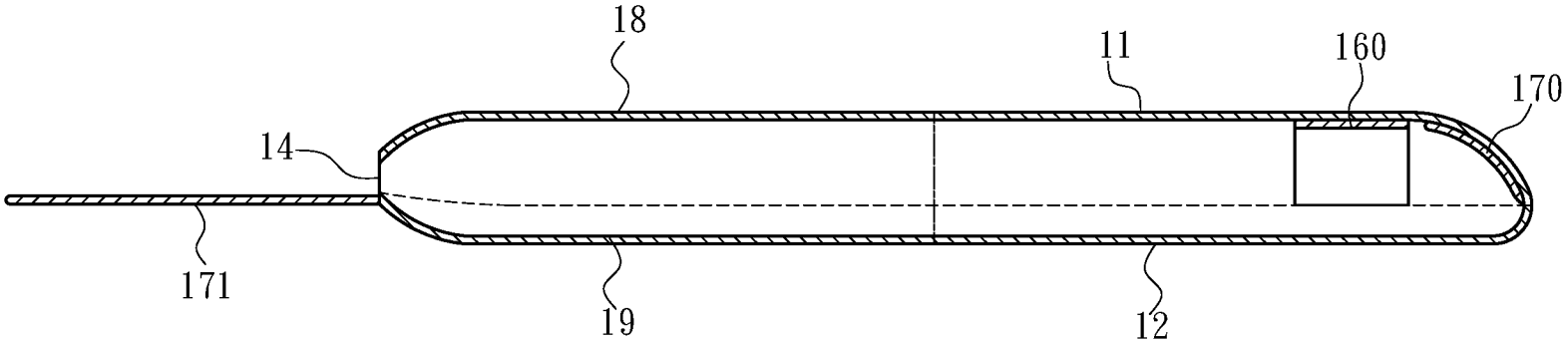
Figure 5D:
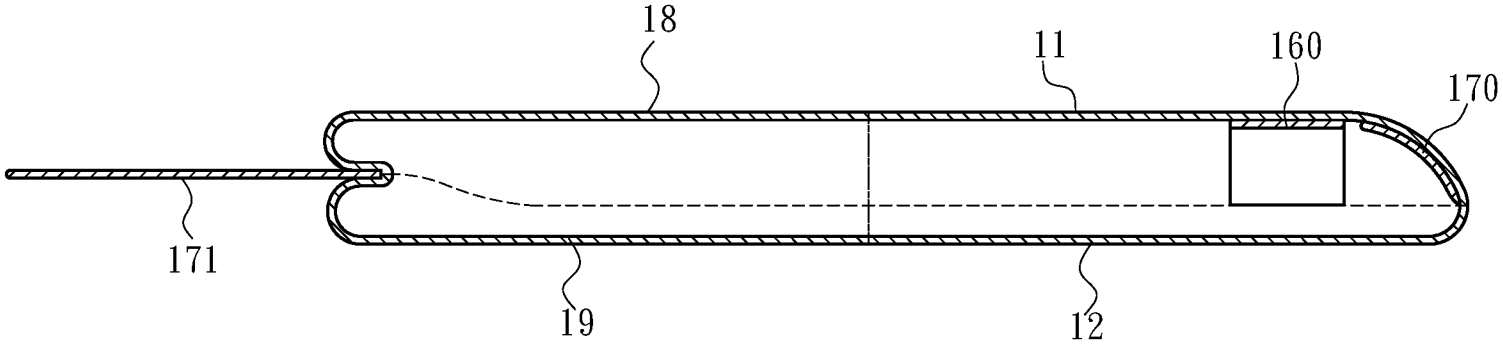
Figure 5E:
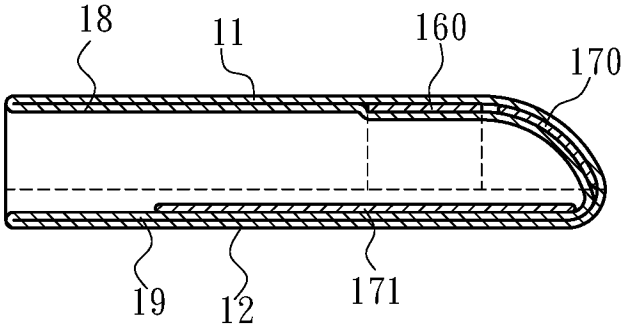

The side overturning step S27 is performed. The side overturning step S27 may be completed through a machine or a human operation without involving the flat knitting machine 90. At the beginning of the implementation, the reinforcement piece 160 is placed on the first shoe upper 11 or the second shoe upper 12, ends of the first lining 18 and the second lining 19 are held firmly, and the first lining 18 and the second lining 19 are folded from the shoe opening 14. During the process of folding the first lining 18 and the second lining 19, the first shoe upper 11 and the second shoe upper 12 are simultaneously drawn to be overturned, so as to locate the reinforcement piece 160 and the extension 170 in the in-shoe space 13 defined by the overturned first shoe upper 11 and second shoe upper 12. At this point, the position of the extension 170 may be adjusted in a way that the extension 170 may serve as the toe support piece or the sole piece. The lining tucking step S28 is performed after the side overturning process is completed. During the implementation of the lining tucking step S28, edges of ends of the first lining 18 and the second lining 19 may be first sewn, i.e., the shoe opening 14 is sewn. The first lining 18 and the second lining 19 are then tucked into the in-shoe space 13. During the implementation of the side overturning step S26, the another extension 171 is together overturned with the connected first lining 18 or second lining 19. In the lining tucking step S27, the another extension 171 is together with the first lining 18 and the second lining 19 tucked into the in-shoe space 13. At this point, a position for installing the another extension 171 may be adjusted according to actual requirements. The another extension 171 serves as the toe support piece when disposed at a toe section of the shoe blank 10, and serves as the sole piece when stacked on the second lining 19. The tucked-in first lining 18 and second lining 19 as well as the another extension 171 are secured at the lower end of the in-shoe space 13 to complete the shoe blank 10, as shown in FIG. 5E.

In this embodiment, the two yarns 20 and 21 forming the shoe blank 10 may be in different colors, which present different colors at inner and outer surfaces of the first shoe upper 11 and the second shoe upper 12. In other words, when the two yarns 20 and 21 are in different colors, a technical front color of a fabric and a technical back color of the fabric are different. Further, one of the two yarns 20 and 21 may be clad by a hot melt layer. Thus, when the shoe blank 10 is completed, it may be placed into a mold and be appropriately heated to allow the yarn 20 (or 21) clad with the hot melt layer to melt, and the shoe blank 10 may then shape according to an appearance of the mold to complete a knitted shoe prototype 100. Further, the two yarns 20 and 21 of the present invention may be intertwined from twisting.

Figure 6:
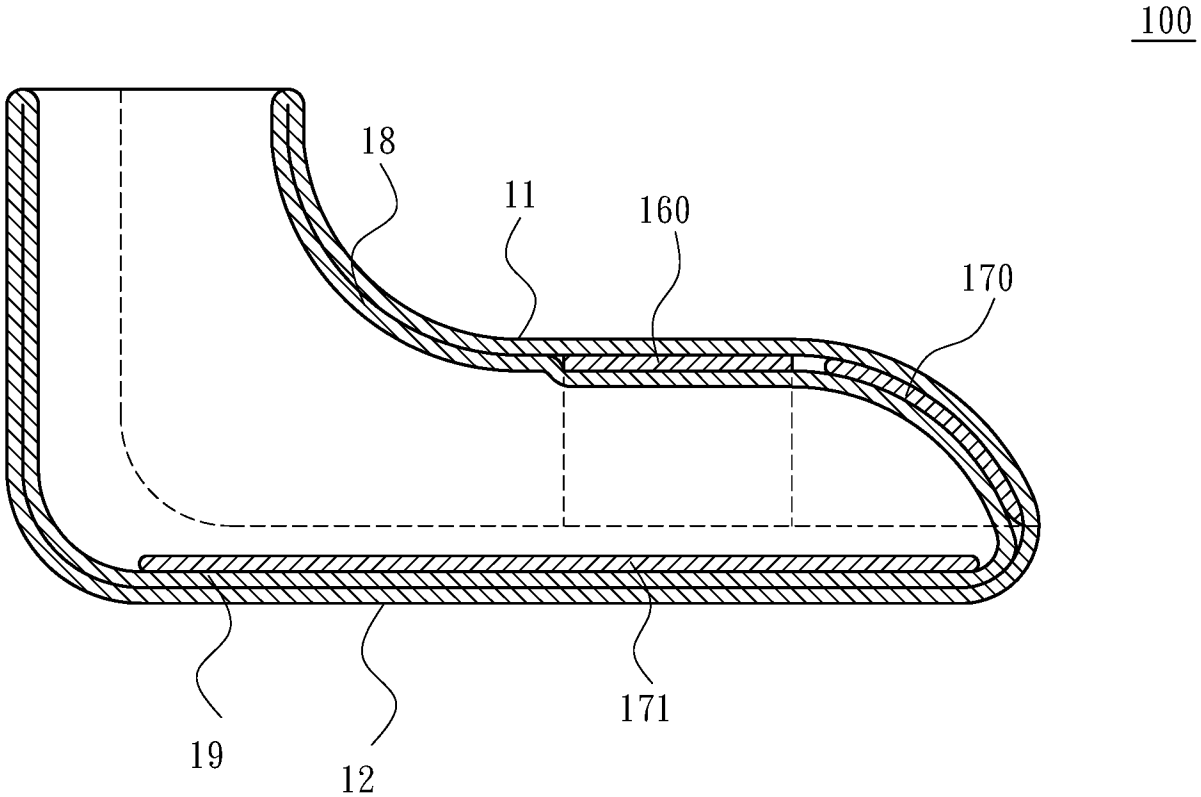
FIG. 6 is a sectional schematic diagram of a knitted shoe prototype according to the first embodiment of the present invention.

Accordingly, after the shoe blank 10 of the embodiment is manufactured, the reinforcement piece 160 and the extension 170 are clamped among the first shoe upper 11, the second shoe upper 12, the first lining 18 and the second lining 19. Thus, the reinforcement piece 160 and the extension 170 cannot be directly contacted in the in-shoe space 13, so as to prevent direct damages of the reinforcement piece 160 and the extension 170 caused by wearing. Further, by performing an appropriate processing on the shoe blank 10, e.g., a heating process or a paint spray process, the knitted shoe prototype 100 may be completed, as shown in FIG. 6. Further, during the knitting process of the present invention, at least one additional part having an identical pattern as the extension 170 may be woven in continuation from the extension 170. The additional part and the extension may be stacked to increase the structural strength provided by the extension 170.

Further, the knitting length of the extension 170 or the another extension 171 is shorter than the knitting lengths of the first shoe upper 11 and the second shoe upper 12.

What is claimed is:

1. A method for manufacturing an integral shoe blank, comprising:

an outside-upper extension knitting step: knitting at least one of at least two yarns to be an extension;

an interlacing step: knitting an initial shoe edge connected to the extension by knitting the at least two yarns in an interlaced manner;

a shoe upper knitting step: forward knitting the at least two yarns connected to the initial shoe edge to be a first portion of a shoe upper, then backward knitting the at least two yarns to be a second portion of the shoe upper that faces the first portion of the shoe upper when a number of a plurality of shoe upper stitches is reached to a predetermined count, further forward knitting the at least two yarns according to the number of the plurality of shoe upper stitches again to be the first portion of the shoe upper, and hence cyclically performing the above process to form the first portion of the shoe upper and the second portion of the shoe upper as a tubular fabric;

a reinforcement piece knitting step: continuing forward knitting at least one of the yarns to be a reinforcement piece when the number of a plurality of shoe upper stitches is reached to the predetermined count in the shoe upper knitting step, then backward knitting the at least one of the yarns when a number of a plurality of extension stitches is knitted to reached a predetermined count, further continuing forward and backward knitting the at least two yarns according to the number of the plurality of shoe upper stitches to be the first portion of the shoe upper and the second portion of the shoe upper when the number of a plurality of extension stitches is reached to the predetermined count again, and cyclically performing the above process to knit the reinforcement piece, the first portion of the shoe upper of the tubular fabric and the second portion of the shoe upper of the tubular fabric;

a continual shoe upper knitting step, cyclically forward and backward knitting the at least two yarns to be the first portion of the shoe upper and the second portion of the shoe upper;

a lining knitting step: knitting the at least two yarns to be a first lining connected to the first portion of the shoe upper, then backward knitting the at least two yarns to be a second lining that faces the first lining and is connected to the second portion of the shoe upper when a number of the shoe upper stitches is reached to a predetermined count, further forward knitting the at least two yarns according to the number of the plurality of shoe upper stitches again to be the first lining, and hence cyclically performing the above process to form the first lining and the second lining, and forming a shoe opening at ends of the first lining and the second lining;

an outside-upper another extension knitting step, in which, another extension connected to the end of the first lining or the end of the second lining is knitted by knitting at least one of the yarns;

a side overturning step: folding the first lining and the second lining from the shoe opening, and simultaneously drawing the first portion of the shoe upper and the second portion of the shoe upper for side overturning to locate the reinforcement piece and the extension in an in-shoe space of the tubular fabric defined by the overturned first portion of the shoe upper and second portion of the shoe upper, wherein the extension serves as a toe support piece at a lower end of the in-shoe space or a sole piece adhered to the second portion of the shoe upper; and a lining tucking step: tucking the overturned first lining and second lining as well as the another extension towards the in-shoe space, and securing ends of the first lining and the second lining to the lower end of the in-shoe space to let the extension and the another extension are respectively the toe support piece disposed at the lower end of the in-shoe space and the sole piece adhered to the second lining, to complete the shoe blank.

2. The method for manufacturing an integral shoe blank of claim 1, wherein before tucking the first lining and the second lining into the in-shoe space in the lining tucking step, edges of the first lining and the second lining are sewn.

3. The method for manufacturing an integral shoe blank of claim 2, wherein one of the two yarns is clad with a hot melt layer.

4. The method for manufacturing an integral shoe blank of claim 2, wherein the number of the plurality of extension stitches is greater than the number of the plurality of shoe upper stitches.

5. The method for manufacturing an integral shoe blank of claim 2, wherein knitting lengths of the extension and another extension connected to an end of the first lining or an end of the second lining are shorter than knitting lengths of the first portion of shoe upper and the second portion of shoe upper.

* * * * *